United States Patent [19]

Jasne et al.

[11] Patent Number: 4,547,451

[45] Date of Patent: Oct. 15, 1985

[54] HYDROLYZABLE DIFFUSION CONTROL LAYERS IN PHOTOGRAPHIC PRODUCTS

[75] Inventors: Stanley J. Jasne, Andover; William C. Schwarzel, Billerica; Charles I. Sullivan, Melrose; Lloyd D. Taylor, Lexington, all of Mass.

[73] Assignee: Polaroid Corporation, Patent Dept., Cambridge, Mass.

[21] Appl. No.: 703,871

[22] Filed: Feb. 21, 1985

Related U.S. Application Data

[63] Continuation-in-part of Ser. No. 493,013, May 9, 1983, abandoned.

[51] Int. Cl.[4] ..... G03C 1/40; G03C 5/54; G03C 7/20

[52] U.S. Cl. ..... 430/215; 430/227; 430/505; 430/536; 430/955

[58] Field of Search ..... 430/215, 216, 227, 536, 430/505, 627, 629, 630, 955

[56] References Cited

U.S. PATENT DOCUMENTS 3,925,083 12/1975 Fitzgerald ..... 430/630
4,120,727 10/1978 Fitzgerald ..... 430/627
4,288,523 9/1981 Taylor ..... 430/215
4,297,431 10/1981 Sullivan ..... 430/215
4,323,644 4/1982 Nakamura et al. ..... 430/216

OTHER PUBLICATIONS

Haas et al., *J. of Polymer Science,* vol. XXXVII, issue 131, pp. 317–319, 1959.

Schaetzle et al., *Helvetica Chimica Acta,* 46, pp. 2418–2424, translation, pp. 1–8, 1963.

Yonezawa, *Yuki Gosei Kagaku Hyokaishi,* 27(12), 1969, pp. 1218–1223, translation, pp. 1–9.

*Primary Examiner*—Richard L. Schilling
*Attorney, Agent, or Firm*—Louis G. Xiarhos

[57] ABSTRACT

Photographic diffusion transfer film units including polymeric diffusion control layers are disclosed. The diffusion control layers comprise polymers which are hydrolyzable in an alkaline medium so as to convert a layer comprising one or more of the polymers from a condition of impermeability to alkali or materials soluble in or solubilized by an aqueous alkaline processing composition to a condition of substantial permeability thereto.

25 Claims, 4 Drawing Figures

HYDROLYZABLE DIFFUSION CONTROL LAYERS IN PHOTOGRAPHIC PRODUCTS

CROSS-REFERENCE TO RELATED PATENT APPLICATION

This application is a continuation-in-part of our copending U.S. Application Ser. No. 493,013, filed May 9, 1983, now abandoned.

BACKGROUND OF THE INVENTION

The present invention relates to photography and particularly to products adapted for employment in forming photographic diffusion transfer images. In particular, the present invention is directed toward photographic diffusion transfer film units including diffusion control layers comprised of certain polymers hydrolyzable in the presence of alkali.

SUMMARY OF THE INVENTION

According to the present invention, there have been discovered certain polymers which comprise recurring units capable of undergoing hydrolysis in an alkaline environment to convert a layer comprising one or more of said polymers from a condition of impermeability to alkali or materials soluble in or solubilized by an aqueous alkaline processing composition to a condition of substantial permeability thereto. Layers comprising these hydrolyzable polymers can be used as diffusion control interlayers or overcoats in diffusion transfer film units or as timing layers in such film units for the predetermined control of diffusion transfer therein.

According to the present invention, there are provided photographic diffusion transfer film units which include at least one diffusion control layer including a hydrolyzable polymer, the layer being adapted to conversion from a condition of impermeability to alkali or materials soluble in or solubilized by an aqueous alkaline processing composition to a condition of substantial permeability thereto, by a predetermined hydrolysis of the polymer by contact with alkali, the hydrolyzable polymer comprising repeating units having the formula (I)

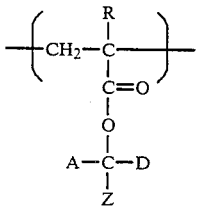

(I)

wherein R is hydrogen, halogen (e.g., chloro) or lower alkyl (e.g., methyl); A and D are each hydrogen, alkyl (e.g., methyl, ethyl), alkoxy (e.g., methoxy), aryl (e.g. phenyl), alkaryl (e.g., tolyl), aralkyl (e.g., benzyl); and Z represents an electron-withdrawing group which, upon contact of the polymer with alkali, activates the hydrolytic degradation of the polymer with accompanying formation of an acrylate anion, or represents an electron-withdrawing group which, upon contact of the polymer with alkali, is itself hydrolyzed with accompanying formation of a residual carboxylate anion.

The diffusion control layers of the photographic film units hereof function by forming an impermeable "barrier" layer which prevents passage or diffusion therethrough of either alkali or materials soluble in or solubilized by an aqueous alkaline processing composition for a predetermined length of time during processing of the film unit and then converting over a relatively short time period to a condition of substantial permeability to these materials as a result of the polymers hereof undergoing said predetermined hydrolysis. The diffusion control layers are, thus, "hold-release" layers in that materials intended to be subject to diffusion control by the layer (such as diffusible image-forming dyes) are "held" in place for a predetermined period of time and then are "released" in substantial quantity over a relatively short time period, i.e., allowed to rapidly diffuse through the layer.

The present invention will be more readily understood by the following detailed description taken in conjunction with the accompanying drawings.

THE DRAWINGS

DETAILED DESCRIPTION

Figure 1:
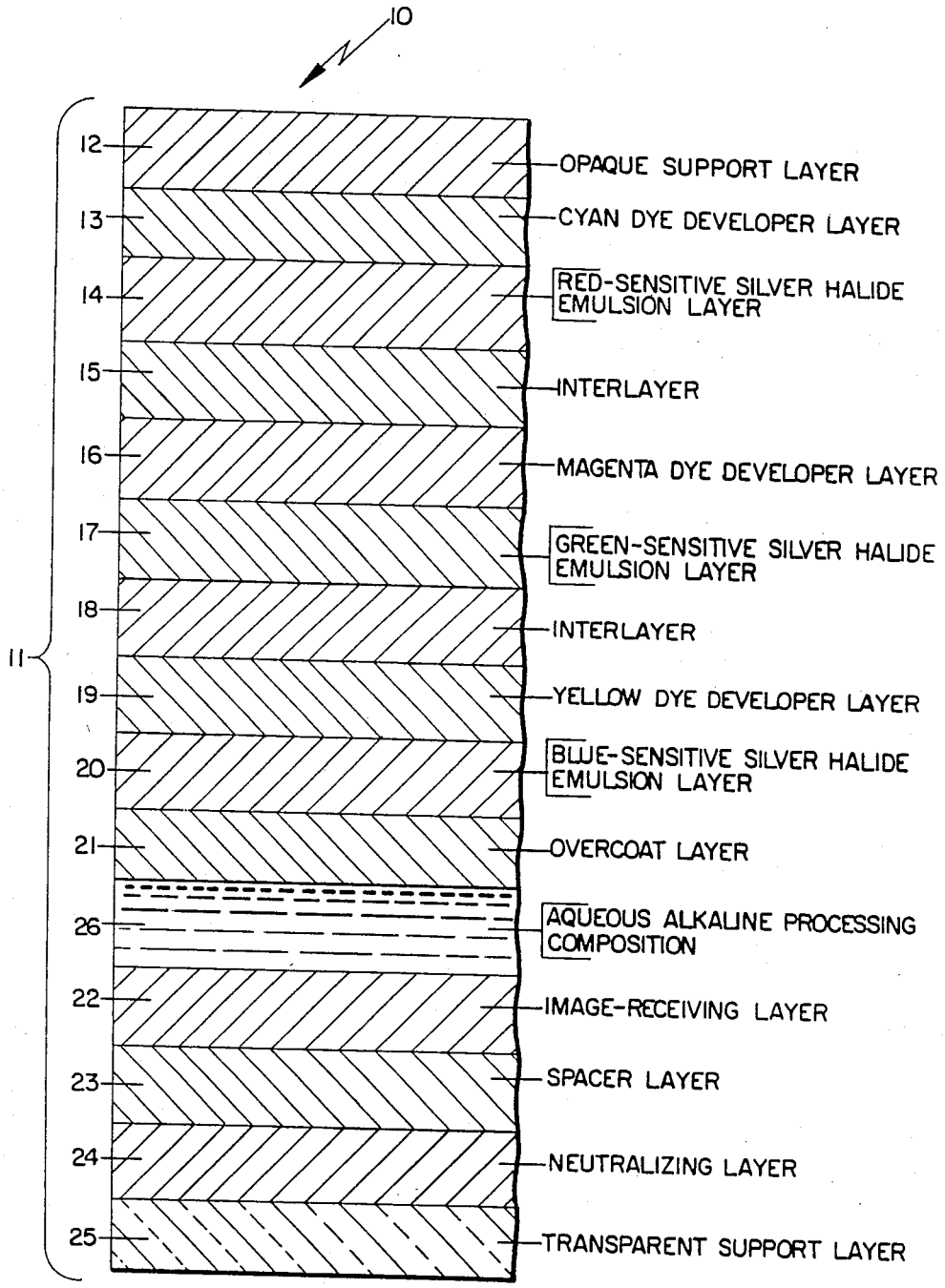
FIG. 1 is a cross-sectional view of a photographic film unit including diffusion control layers of this invention.

As mentioned hereinabove, the hydrolyzable polymers hereof are capable of converting a layer comprising one or more of the polymers from a condition of impermeability to alkali or materials soluble in or solubilized by an aqueous alkaline processing composition to a condition of substantial permeability thereto by undergoing a hydrolysis reaction in an alkaline environment. Thus, the polymers can be variously used in diffusion control layers of photographic diffusion transfer film units. The diffusion control layer can, for example, be an overcoat or interlayer in a photosensitive element or negative component of a diffusion transfer film unit or can be a timing layer or overcoat in an image-receiving element or positive component of a diffusion transfer film unit. The desirable "hold-release" behavior of the diffusion control layers hereof may be contrasted with the diffusion control properties of diffusion control layers which are not capable of undergoing a precipitous change in permeability but rather are initially permeable to some degree, and thus allow a slow leakage of material from the start of processing, and gradually become more permeable during the processing interval.

The polymers of the diffusion control layers hereof comprise recurring units capable of undergoing hydrolytic degradation in the presence of alkali and comprise repeating units having the formula (I)

(I)

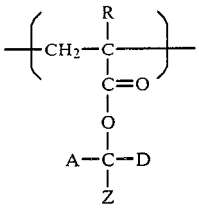

wherein R is hydrogen, halogen (e.g., chloro) or lower alkyl (e.g., methyl); A and D are each hydrogen, alkyl (e.g., methyl, ethyl), alkoxy (e.g., methoxy), aryl (e.g., phenyl), alkaryl (e.g., tolyl), aralkyl (e.g., benzyl); and Z represents an electron-withdrawing group which, upon contact of the polymer with alkali, activates the hydrolytic degradation of the polymer with accompanying formation of an acrylate anion, or represents an electron-withdrawing group which, upon contact of the polymer with alkali, is itself hydrolyzed with accompanying formation of a residual carboxylate anion.

It will be seen from inspection of the repeating units of formula (I) that the polymers of the present invention are derived from the monomeric compounds containing a pendant

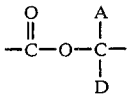

moiety characteristic of esters and that the esters contain a substituent moiety, Z. For purpose of brevity and convenience, the repeating units of formula (I) are hereinafter referred to simply as "hydrolyzable units".

The nature of the Z group of the hydrolyzable units can vary depending upon the predetermined and desired diffusion control characteristics of a layer containing the polymer hereof, on the nature of any comonomeric units as may be present in the polymer, or the nature of other polymeric materials as may be present in admixture with the polymer hereof in a diffusion control layer. In general, the Z group will be a moiety which activates or assists in the degradation of the polymers by alkaline hydrolysis of the pendant ester group or will be a moiety which itself is hydrolyzed with accompanying formation of a residual carboxylic anion, as described hereinafter.

Suitable electron-withdrawing groups, Z, include, for example, groups of the formula

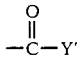

wherein Y represents $-R^2$ or $-OR^2$, where $R^2$ is alkyl (e.g., methyl, ethyl), aryl (e.g., phenyl), alkaryl (e.g., tolyl) or aralkyl (e.g., benzyl); or wherein Y represents

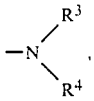

where each of $R^3$ and $R^4$ is independently hydrogen, alkyl, aryl, alkaryl or aralkyl, or $R^3$ or $R^4$ represent the atoms necessary to complete, with the nitrogen atom to which they are bonded, a nitrogen-containing heterocyclic ring; or wherein Y represents the radical

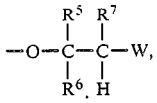

where each of $R^5$, $R^6$ and $R^7$ is methyl or phenyl, except that not more than one of $R^5$, $R^6$ and $R^7$ is methyl or phenyl, and W is an electron-withdrawing group capable of activating a $\beta$-elimination (e.g., methylsulfonyl). Other suitable electron-withdrawing Z groups include cyano, pyridinium and $-SO_2-R^8$ wherein $R^8$ is alkyl, aryl, alkaryl or aralkyl. It will be appreciated that the cyano group, owing to possible by-product formation of hydrogen cyanide, will not be a preferred Z group herein.

Preferred Z groups herein are electron-withdrawing groups having the formula

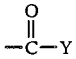

wherein Y is alkyl (e.g., methyl) or alkoxy (eg., methoxy or ethoxy). Accordingly, preferred polymers herein are polymers including repeating units of Formula (II) or (III) as follows, where R is hydrogen or lower alkyl and $R^2$ is alkyl:

(II)

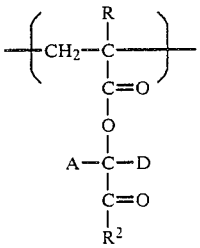

or (III)

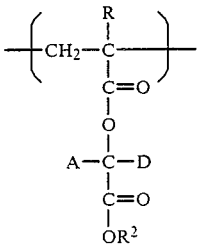

Preferably, each of A and D is hydrogen, although in the case of repeating units of type represented by Formula II, it will be preferred that each of A and D be methyl.

While the manner in which polymers containing repeating units according to Formulas (I), (II) or (III) function to provide the aforesaid hold-release functionality is not completely understood, it is believed that a mechanism of alkali-activated ester hydrlysis is involved. Depending upon the particular nature of the Z electron-withdrawing group, one or more mechanisms may be involved. It is believed that the Z group in some cases activates the hydrolysis of the pendant ester group such as is illustrated by resort to the following reaction scheme illustrating the alkali-initiated hydrolytic degradation of a polymer having repeating units from acetonyl acrylate.

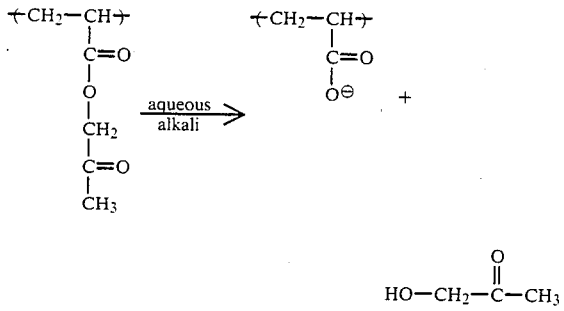

The Z group in the above-illustrated acetonyl acrylate polymer (i.e., the $CH_3-\overset{O}{\overset{\|}{C}}-$ group)

is believed to activate the hydrolysis of the pendant ester group thereof with the accompanying degradation and formation of the anionic acrylate species. The hydrolytic degradation occurs after a predetermined "hold" time such that an increase in permeability of a layer containing the polymer is observed.

In some cases, hydrolytic degradation can occur as the result of hydrolysis of the Z group itself and accompanying formation of a carboxylic anionic species. It will be understood that the carboxylic anionic species can activate or assist further hydrolysis with formation of an acrylate anion, as is illustrated by the following reaction scheme:

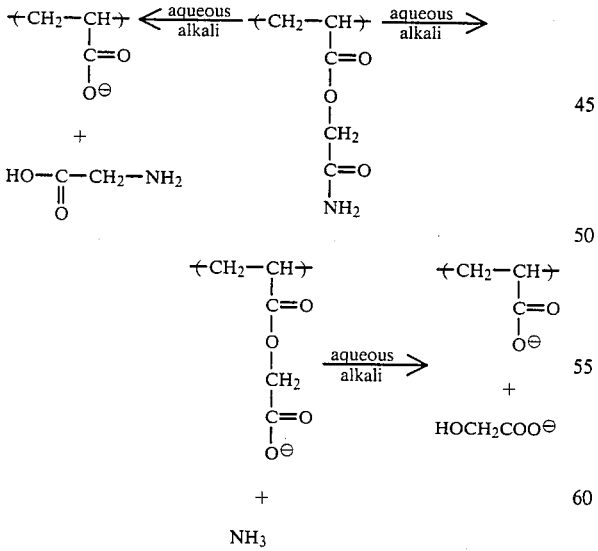

While applicants do not wish to be bound by any particular theory or mechanism in explanation of the hydrolytic effects of alkali on the substituted esters hereof, it is believed that one or both of the aforedescribed mechanisms can be involved in the degradation of an ester-substituted ester, as can be appreciated from the following reaction scheme:

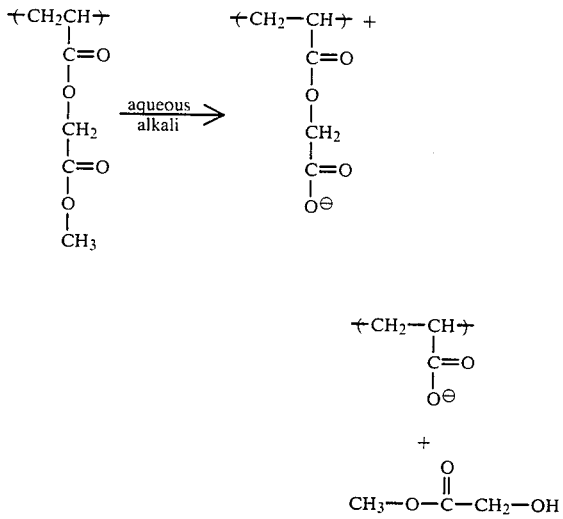

Examples of polymers useful herein include those containing the hydrolyzable repeating units of the following formulas:

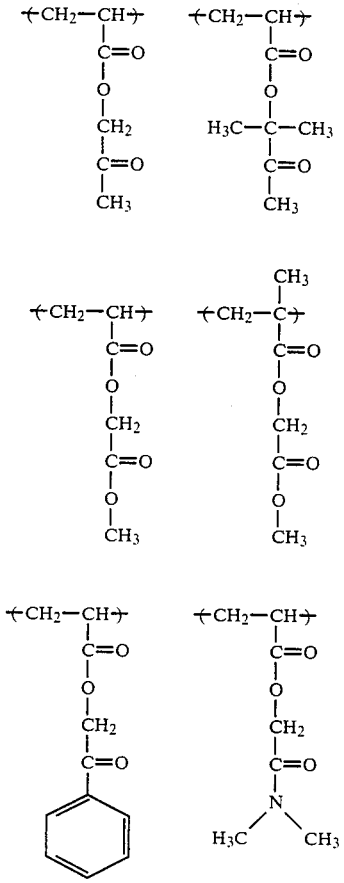

-continued

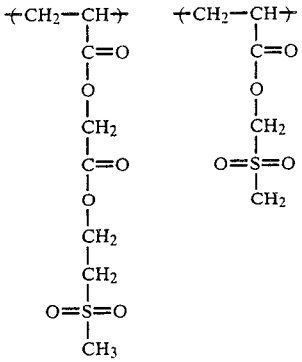

The polymers of this invention can be copolymers comprising the substituted-ester hydrolyzable units and a variety of comonomeric units incorporated into the polymer to impart thereto predetermined properties. For example, the "hold time", i.e., the time interval during which a diffusion control layer remains impermeable during processing, can be affected by the relative hydrophilicity of the layer resulting from incorporation of a given comonomer or mixture of comonomers into the hydrolyzable polymer. In general, the more hydrophobic the polymer, the slower will be the rate of permeation of alkali into a diffusion control layer to initiate the hydrolysis reaction, i.e., the longer the hold time. Alternatively, adjustment of the hydrophobic/hydrophilic balance of the polymer by inclusion of appropriate comonomeric units may be used to impart selective permeability characteristics to a diffusion control layer as appropriate for a given usage within a film unit. For example, as detailed hereinbelow, it is highly preferred that diffusion control interlayers in a film unit be initially substantially permeable to alkali, water, and various other components of the processing composition while substantially impermeable to the image-providing materials of the film unit up to a predetermined point in the development process. Such selective permeability can be achieved in the present invention by inclusion of appropriate comonomeric units, generally of a relatively hydrophilic nature, into the hydrolyzable polymers hereof or, more particularly, by "balancing" the hydrophobic and hydrophilic moieties to achieve the desired permeability.

Examples of suitable comonomers for use in the present invention include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(β-hydroxy ethyl)acrylamide, N-(β-dimethylaminoethyl)acrylamide; N-(t-butyl)acrylamide; N-[β-(dimethylamino)ethyl]methacrylamide; 2-[2'-(acrylamido)ethoxy]ethanol; N-(3'-methoxy propyl)-acrylamide; 2-acrylamido-3-methyl butyramide; acrylamido acetamide; methacrylamido acetamide; 2-[2'-methacrylamido-3'-methyl butyramido]acetamide; and diacetone acrylamide.

As examples of preferred copolymers useful herein as hold/release polymers in photographic products, mention may be made of:

1. The copolymer of diacetone acrylamide/butyl acrylate/acrylic acid/ethyl acrylate/carbomethoxymethyl acrylate (18.6/37.5/1.4/21.0/20.0 parts by weight): and 2. The copolymer of diacetone acrylamide/butyl acrylate/acrylic acid/ethyl acrylate/carbomethoxymethyl acrylate (39.25/30.00/0.25/15.25/15.25 parts by weight.

The hydrolytic degradation which the hydrolyzable polymers of the diffusion control layer of this invention undergo ensures that those materials intended to be subject to diffusion control by the diffusion control layer are "held" in place for a predetermined period of time and then "released" over a relatively short time period, the polymer layer undergoing a relatively rapid increase in hydrophilicity and water swellability and, thus, permeability as a result of the hydrolysis reaction. The predetermined hold time may be adjusted as appropriate for a given photographic process by means such as controlling the mole ratio or proportion of hydrolyzable units in the polymer; altering the thickness of the diffusion control layer; incorporating appropriate comonomeric units into the polymer to impart thereto a desired hydrophobic/hydrophilic balance or degree of coalescence; utilizing different electron-withdrawing groups Z to affect the rate of hydrolysis; or utilizing other materials, particularly polymeric materials, in the diffusion control layer to modulate the permeation therethrough of alkali or aqueous alkaline processing composition, thereby altering the time necessary for substantial hydrolysis to occur. This latter means of adjusting the hold time of the layer may include, for example, utilization of a matrix polymer material having a predetermined permeability to alkali or aqueous alkaline processing composition as determined, for example, by the hydrophobic/hydrophilic balance or degree of coalescence thereof. In general, increased permeability to alkali or aqueous alkaline processing composition and, thus, a shorter hold time, may be obtained by increasing the hydrophilicity of the matrix polymer or decreasing the degree of coalescence.

In addition to affecting the hold time of the diffusion control layers of this invention, matrix polymers may also be used to modulate the permeability of the layers to alkali or materials soluble in or solubilized by an aqueous alkaline processing composition and thus affect the functionality of the layers within a film unit. For example, relatively hydrophobic matrix polymers or matrix polymers having a relatively high degree of coalescence may help to render diffusion control layers hereof substantially impermeable to alkali until hydrolysis occurs, thus providing functionality to such layers as alkali neutralization timing layers or overcoat layers in image-receiving elements or other elements of diffusion transfer film units. Alternatively, relatively hydrophilic matrix polymers or matrix polymers having a relatively low degree of coalescence may help to render diffusion control layers hereof initially permeable to alkali while remaining impermeable to materials soluble in or solubilized by an aqueous alkaline processing composition, e.g., image dye-providing materials, until hydrolysis occurs, thus providing functionality to such layers as interlayers or overcoat layers in photosensitive elements negative components or other elements of diffusion transfer film units.

Utilization of matrix polymers can thus provide an alternative or complementary means to the above-mentioned use of suitable comonomers in the hydrolyzable copolymers hereof as a method of modulating the hold time or functionality of the diffusion control layers of this invention. It will be understood, however, that the hydrolysis of the hydrolyzable units is necessary to achieve the relatively rapid change in permeability of the layer.

Matrix/hydrolyzable unit polymer systems adapted to utilization in a diffusion control layer can be prepared by physical mixing of the respective polymers, or by preparation of the matrix polymer in the presence of the hydrolyzable polymer. For example, a polymer containing hydrolyzable units can be formed in the presence of a preformed matrix polymer. Polymers which may be used as matrix polymers will generally be copolymers which comprise comonomeric units such as acrylic acid; methacrylic acid; methylmethacrylate; 2-acrylamido-2-methylpropane sulfonic acid; acrylamide; methacrylamide; N,N-dimethylacrylamide; ethylacrylate; butylacrylate; diacetone acrylamide; acrylamido acetamide; and methacrylamido acetamide. The comonomeric units, as well as the ratios thereof, should be chosen on the basis of the physical characteristics desired in the matrix polymer and in the diffusion control layer in which it is to be utilized. For example, a more hydrophilic and thus a generally more permeable matrix material can be had by increasing the respective ratio of hydrophilic comonomers, such as acrylic acid or methacrylic acid, within the matrix polymer.

A particularly preferred matrix/hydrolyzable unit polymer system is a matrix system comprising about 80 to 90 parts by weight of a 50.5/44/5/0.5 part-by-weight matrix copolymer of diacetone acrylate/butyl acrylate/acrylic acid/2-acrylamido-2-methylpropane sulfonic acid; and the balance to 100 parts, i.e., 10 to 20 parts, of a 75/25 part-by-weight copolymer of carbomethoxymethyl acrylate/diacetone acrylamide.

Reference has been made to the utilization (in diffusion control layers containing the hydrolyzable polymers) of other materials, particularly polymeric materials, to adjust the hold time of the layer in a predetermined manner and as appropriate for a given photographic process. It will be understood, however, that the presence in a diffusion control layer of the invention of polymeric or other materials which adversely affect or negate the desired diffusion control properties of the layer is to be avoided. In this connection, it should be noted that gelatin, and particularly unhardened gelatin, is readily swollen and permeated by aqueous alkaline compositions typically employed in photographic processing. Accordingly, the presence in a diffusion control layer of the invention of amounts of gelatin or other materials which promote rapid permeation of the layer by alkali and which effectively negate the hold character of the layer, are to be avoided.

As used herein, a diffusion control layer of the invention refers to a layer which is free of permeation-promoting materials which adversely affect the capacity of the layer to maintain a condition of impermeability to alkali, or materials soluble in or solubilized by an alkaline processing composition, until the desired and predetermined occurrence of the hydrolysis reaction and the accompanying conversion of the layer to a condition of substantial permeability thereto.

The hydrolyzable polymers hereof can be utilized in a number of diffusion transfer products and processes based upon imagewise transfer of a diffusible image-providing material, e.g., a diffusible dye, dye intermediate, or soluble silver complex. The diffusion transfer film units of the present invention comprise as essential layers, a support layer; at least one photosensitive silver halide emulsion layer having associated therewith a diffusion transfer process image-providing material; an alkaline processing composition permeable image-receiving layer; and at least one diffusion control layer comprising the hydrolyzable polymers. Following photoexposure, the silver halide emulsion is developed with an aqueous alkaline processing composition and, as a function of development, an imagewise distribution of diffusible image-providing material is formed which is transferred, at least in part, to the superposed image-receiving layer. The diffusion control layers of such film units may be used to control diffusion of alkali or of the image-providing material in accordance with the disclosures contained herein.

Film units within the present invention include those wherein the silver halide emulsion layers and the image-receiving layer are initially contained in separate elements. Such film units may thus comprise: (a) a photosensitive element comprising a support layer which is preferably opaque and a negative component comprising at least one photosensitive silver halide emulsion layer having associated therewith a diffusion transfer process image-providing material; (b) an image-receiving element comprising a support layer which may be opaque or transparent as appropriate for a given process and a positive component comprising an image-receiving layer; and (c) a diffusion control layer comprising the polymers of this invention in at least one of said photosensitive element or image-receiving element. The respective elements may be brought into superposition subsequent or prior to exposure. Subsequent to exposure, an aqueous alkaline processing composition is distributed between the superposed elements to initiate development. If the image-receiving element provides an opqaue reflective background, the image formed may be viewed as a reflection print upon separation of the elements. By using a transparent image-receiving element, the resultant image may be viewed as a transparency upon separation of the elements. Alternatively, if the photosensitive element and/or processing composition contains a light reflecting layer, e.g., a white pigment such a titanium dioxide, the image may be viewed as a reflection print against the background provided by the light-reflecting layer, without separation of the elements. The photosensitive element may also comprise a neutralization layer, e.g., an acid polymer layer, and a timing layer positioned between the support layer and the negative component with the neutralization layer positioned adjacent the support. By conduct of a neutralization reaction between the acid-reactive sites of the neutralization layer and the alkali provided by the processing composition the environmental pH of the film unit may be lowered. The timing layer functions to prevent premature pH reduction by slowing diffusion of the alkali toward the neutralization layer.

The diffusion control layers of this invention can also be used in diffusion transfer film units wherein the photosensitive layers and image-receiving layer are in a single element, i.e. integral negative-positive film units wherein the negative and positive components are contained in a photosensitive laminate or otherwise retained together in a superposed relationship at least prior to exposure. For example, the diffusion control layers herein can be used in integral film units of the type described in U.S. Pat. No. 3,415,644, which film units are particularly adapted for formation of color images. Film units of this type include, for example, those comprising: (a) a photosensitive laminate comprising a composite structure containing, in sequence, an opaque support layer, preferably an actinic radiation-opaque flexible sheet material, a negative component comprising at least one photosensitive silver halide emulsion layer having associated therewith an image dye-providing material, a positive component comprising an image-receiving layer dyeable by the image dye-providing material, and a transparent support layer, preferably an actinic radiation transmissive flexible sheet material, the photosensitive laminate also comprising a diffusion control layer comprising the polymers of the present invention; (b) means retaining an aqueous alkaline processing composition integrated with the film unit so that the processing composition can be distributed between the negative and positive components. In this type of film unit a light-reflecting pigment is preferably provided by the processing composition such that the distribution of the processing composition between the negative and positive components provides a light-reflecting layer against which a dye image formed in the image-receiving layer can be viewed without separation of the components.

The diffusion control layers of this invention can also be used in integral negative-positive film units of the type described in U.S. Pat. No. 3,594,165. Film units of this type include, for example, those comprising: (a) a photosensitive laminate comprising, in sequence, a transparent support layer, preferably an actinic radiation transmissive flexible sheet material, a positive component comprising an image-receiving layer, a processing composition permeable, light-reflecting layer against which a dye image formed in the image-receiving layer can be viewed, and a negative component comprising at least one photosensitive silver halide emulsion layer having associated therewith an image dye-providing material; (b) a transparent sheet superposed substantially coextensive the surface of photosensitive laminate opposite the transparent layer; (c) means retaining an aqueous alkaline processing composition, which includes an opacifying agent, integrated with the film unit such that the processing composition can be distributed between the photosensitive laminate and the transparent sheet; and (d) a diffusion control layer comprising a polymer of the present invention, which layer may be a component of the photosensitive laminate or a coating on that side of the transparent sheet contiguous the photosensitive laminate. Color images formed within the image-receiving layer can be viewed against the background of the light-reflecting layer without separation of the transparent sheet from the photosensitive laminate.

If desired, and as illustrated in the film unit of EXAMPLE 7 hereof, the essential photosensitive and image-receiving layers and a diffusion control layer hereof can be provided on a single support layer and the film unit can be processed, for example, by imbibing the photoexposed film unit in a photographic processing composition.

Multicolor images may be prepared in the film units of the present invention which comprise at least two selectively sensitized silver halide emulsion layers, each associated with an image dye-providing material which provides an image dye possessing spectral absorption characteristics substantially complementary to the predominant sensitivity range of its associated emulsion. The most commonly employed negative components for forming multicolor images are of the tripack structure and contain blue, green, and red sensitive silver halide layers each having associated therewith in the same or a contiguous layer a yellow, a magenta, and a cyan image dye-providing material respectively. It is preferred that each of the silver halide emulsion layers, and its associated image dye-providing material, be spaced from the remaining emulsion layers, and their associated image dye-providing materials, by separate alkaline solution permeable interlayers, such as those provided by the instant invention.

As disclosed in U.S. Pat. No. 2,983,606 and a number of other patents, image dye-providing materials which are particularly useful in forming color images by diffusion transfer are the dye developers, i.e., compounds which contain, in the same molecule, both the chromophoric system of a dye and also a silver halide developing function. In a typical diffusion transfer system, each dye developer is associated with a separate silver halide emulsion layer and is, most preferably, substantially soluble in the reduced form only at the first pH provided by the processing composition, possessing subsequent to photoexposure or processing a spectral absorption range substantially complementary to the predominant sensitivity range of its associated emulsion. Following photoexposure, the processing composition is applied and permeates the emulsion layers to initiate development of the latent image contained therein. The dye developer is immobilized or precipitated in exposed areas as a consequence of the development of the latent image. In unexposed and partially exposed areas of the emulsion, the dye developer is unreacted and diffusible and thus provides an imagewise distribution of unoxidized dye developer dissolved in the liquid processing composition, as a function of the point-to-point degree of exposure of the silver halide emulsion. At least part of this image-wise distribution of unoxidized dye developer is transferred, by imbibition, to a superposed image-receiving layer, said transfer substantially excluding oxidized dye developer. The image-receiving layer receives a depth-wise diffusion, from the developed emulsion, of unoxidized dye developer without appreciably disturbing the imagewise distribution thereof to provide the reversed or positive color image of the developed image. The image-receiving layer may contain agents adapted to mordant or otherwise fix the diffused, unoxidized dye developer. Subsequent to substantial transfer image formation, it is preferred that the environmental pH of the film unit be adjusted downward to a second pH at which the residual dye developers remaining within the negative structure are precipitated or otherwise rendered non-diffusible in either their reduced or oxidized state. The pH adjustment is generally accomplished by means of an acid neutralization layer, preferably a polymeric acid layer, as detailed hereinbelow.

For purpose of illustration, the present invention will hereinafter be described in terms of dye developers which function as described above, although no limitation of the invention to the illustrative image dye-providing materials is intended.

As illustrated in the accompanying drawings, FIG. 1 sets forth a perspective view of an integral film unit of the type described in referenced U.S. Pat. No. 3,415,644, shown with the processing composition 26 distributed between the negative and positive components. Film unit 10 comprises photosensitive laminate 11 including in order, opaque support layer 12; cyan dye developer layer 13; red-sensitive silver halide emulsion layer 14; interlayer 15; magenta dye developer layer 16; green-sensitive silver halide emulsion layer 17; interlayer 18; yellow dye developer layer 19; blue-sensitive silver halide emulsion layer 20; overcoat layer 21; image-receiving layer 22; spacer layer 23; neutralizing layer 24; and transparent support layer 25. Following photoexposure through transparent support layer 25, processing composition 26, initially remained in a rupturable container (not shown) is distributed between overcoat layer 21 and image-receiving layer 22 to initiate development of the silver halide emulsion layers. It is preferred that processing composition 26 contains an opacifying agent of the type described for example, in U.S. Pat. No. 3,647,437, such that the layer of processing composition 26 is able to prevent further exposure of the photosensitive layers of the film unit during the processing of the film unit outside of the camera. As a consequence of development, an imagewise distribution of diffusible dye developer is formed which is transferred, at least, in part to image-receiving layer 22. The layer provided by processing composition 26 preferably comprises a light-reflecting pigment, such as titanium dioxide, against which the color image formed in image-receiving layer 22 can be viewed. Subsequent to substantial transfer image formation, a sufficient portion of the alkali provided by processing composition 26 permeates image-receiving layer 22 and spacer layer 23, to gain access to neutralizing layer 24 whereupon neutralization of the alkali occurs to lower the pH of the system to a level at which the dye developers are insoluble and non-diffusible, to provide thereby a stable color transfer image.

Rather than being positioned between image-receiving layer 22 and support layer 25, spacer layer 23 and neutralizing layer 24 may be disposed intermediate support layer 12 and cyan dye developer layer 13, with neutralizing layer 24 positioned adjacent to support layer 12. In this embodiment, the alkali provided by processing composition 26 permeates layers 13 through 21 and spacer layer 23 to gain access to neutralizing layer 24 whereupon neutralizing of the alkali is effected as described hereinabove.

With multicolor diffusion transfer products such as those described above, undesirable inter-image effects may occur whereby a given dye developer or other image dye-providing material is controlled as a result of association with a silver halide emulsion layer other than the one with which it is initially associated in the film unit. This unintended associative relationship generally results from migration of the image dye-providing material to a silver halide layer other than the one with which it is initially associated prior to development of the "wrong" emulsion layer. As a result of this premature migration, the image dye-providing material may acquire diffusion characteristics opposite to those it would normally possess had it remained in association with its intended controlling silver halide. For example, if a dye developer prematurely migrates to a silver halide layer other than the one with which it is initially associated, it may undergo oxidation to a non-diffusible species as a function of the development of this "wrong" layer and will be rendered incapable of transferring as intended to the image-receiving layer. As a result, accuracy in color reproduction and color saturation within the transfer image will be adversely affected. In addition, a portion of a second dye developer which should have undergone oxidation as a function of the development of this "wrong layer" remains in a reduced and diffusible state and, thus, may transfer to contaminate the resultant color transfer image. These inter-image effects may be more specifically exemplified by reference to FIG. 1. If it is possible for the magenta dye-developer of layer 16 to back-diffuse to red-sensitive silver halide emulsion layer 14 before substantial development of this layer and resultant substantial formation of an imagewise distribution of the cyan dye developer in layer 13, some of the magenta dye developer may become oxidized and rendered non-diffusible as a function of red exposure and development of the red-sensitive emulsion layer. Thus, there is produced a loss in magenta dye density in the transfer image. Moreover, that portion of cyan dye developer which should have been oxidized in preference to the magenta dye developer remains in the reduced form and may diffuse to image-receiving layer 22 with resultant cyan dye contamination of the transfer image. Thus, accurate color reproduction of a photographed object is hindered by such inter-image effects.

To obviate or minimize inter-image effects, diffusion control layers hereof may be employed as interlayers positioned between the respective silver halide layers, and their associated dye developers, such as interlayers 15 and 18 in FIG. 1. The hydrolysis step undergone by the hydrolyzable polymer(s) within these layers ensures a delay in permeability of these layers during initial processing of the film unit and thus "holds" the dye developer and substantially prevents diffusion to unassociated silver halide layers at least until after substantial development of these layers and formation of the intended imagewise distributions of the dye developers. The "release" of the diffusible dye developers should occur prior to substantial fogging of the emulsion layer with the most rapid fogging rate. It will be appreciated that the "hold-release" behavior of the interlayers of this invention provides advantages over those interlayers which allow a slow leaking of dye developer at the start of the processing interval in that the dye developers are better confined to their associated emulsion layer during the critical initial development interval and then released rapidly and in substantial quantity so as to allow rapid and essentially simultaneous transfer of the color image-forming materials.

In addition to minimizing the above described inter-image effects, interlayers comprising the polymers of this invention may be used to provide increased capacity for accurate color reproduction over a range of temperatures. In general, the lowering of the temperature at which processing occurs slows both the rate of development and the rate of dye diffusion. If the respective rates are slowed disproportionately, i.e., if the decrease in the development rate is proportionately greater than the decrease in the rate of diffusion, color reproduction may be adversely affected by diffusion of the dye away from its associated emulsion layer prior to substantial development of that layer. This type of premature migration may be minimized by use of interlayers comprising the polymers of this invention which have been found to provide markedly longer "hold" times at lower temperatures, e.g., 7° C. relative to the "hold" time observed at higher temperatures, e.g., 24° C. Thus, the interlayers may be utilized to hold the dye developer in association with the silver halide emulsion for longer time periods at lower temperatures to accommodate the system to slower development rates at these temperatures while allowing for a proportionately faster "release" as the temperature and development rate increase.

The polymers of this invention useful as interlayer materials as described hereinabove can also be utilized in overcoat layers of photosensitive elements or negative component overcoat layers such as overcoat layer 21 in FIG. 1. Such overcoat layers can be used, for example, to prevent premature migration of the dye developer most proximate to the distributed processing composition or to provide a means by which the various color image-forming materials may be made available essentially simultaneously to the mordant sites within the image-receiving layer.

The processing compositions employed in diffusion transfer processes of the type contemplated herein usually are highly alkaline, having a pH in excess of 12 and frequently in excess of 14 or higher. In general, the highly alkaline environment facilitates the conduct of dye diffusion to provide satisfactory diffusion rates and image dye densities. As disclosed in U.S. Pat. No. 3,362,819 it is highly desirable that the environmental pH of the film unit be lowered to at least 11 or lower subsequent to substantial transfer image formation to achieve improved stability to the dye image. U.S. Pat. No. 3,415,644 discloses that in integral film units wherein the negative and positive components remain in a superposed contiguous relationship subsequent to substantial transfer image formation, an in-process adjustment of the environmental pH of the film unit from a pH at which transfer processing is operative to a pH at which dye transfer is inoperative subsequent to substantial transfer image formation is highly desirable in order to achieve a more stable dye transfer image in terms of the chemical and light stability of the image dye molecules and in terms of preventing postprocessing transfer of residual image dye-providing materials within the negative structure to the image-receiving layer.

As disclosed in previously referenced U.S. Pat. No. 3,362,819, reduction in the environmental pH of the film unit is preferably achieved by conduct of a neutralization reaction between the alkali provided by the processing composition and a layer comprising immobilized acid reactive sites, i.e., a neutralization layer. Preferred neutralization layers are those comprising a polymeric acid such as cellulose acetate hydrogen phtalate; polyvinyl hydrogen phtalate; polyacrylic acid; polystyrene sulfonic acid; and partial esters of polyethylene/-maleic anhydride copolymers.

Premature pH reduction, as evidenced, for example, by a decrease in image dye density, can be prevented by interposing, between a neutralization layer and a layer of processing composition, a spacer or timing layer which slows diffusion of the alkali toward the neutralization layer. As indicated hereinabove, diffusion control layers of this invention may be used as such timing layers, forming an alkali impermeable barrier for a predetermined time interval and then converting to a relatively alkali permeable condition upon occurrence of hydrolysis to allow the alkali access to the neutralization layer in a rapid and quantitavely substantial fashion.

The timing layers comprising the hydrolyzable polymers hereof can be used in image-receiving elements of the type disclosed in U.S. Pat. No. 3,362,819 or as a component part of the positive component of integral negative-positive film units of the type disclosed in previously referenced U.S. Pat. Nos. 3,415,644 and 3,594,165. Alternatively, the timing and neutralization layers may be associated with the negative component as is disclosed, for example, in U.S. Pat. Nos. 3,362,821 and 3,573,043. In film units of the present invention of the type disclosed in referenced U.S. Pat. No. 3,594,165, these layers may also be carried by a transparent sheet employed to facilitate application of a processing composition.

Figure 2:
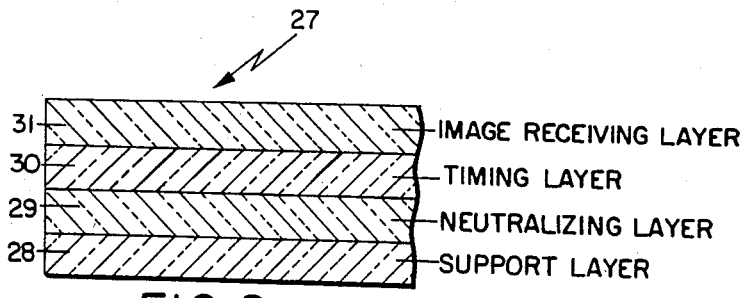
FIG. 2 is a cross-sectional view of an image-receiving element including a diffusion control timing layer of this invention.

Illustrated in FIG. 2 is an image-receiving element of the present invention. Image-receiving element 27 comprises in order a support layer 28, a neutralizing layer 29, a spacer of timing layer 30 comprising a hydrolyzable polymer of the present invention, and an image-receiving layer 31. During processing the image-receiving layer is situated contiguous the layer of processing composition. The processing composition penetrates image-receiving layer 31 to provide a sufficient pH for image formation therein and is then subsequently neutralized by penetrating through timing layer 30 upon hydrolysis of the diffusion control polymer contained therein to gain access to neutralizing layer 29.

As indicated previously, the permeability of the diffusion control layers of this invention to alkali may be controlled in a predetermined manner by the use of comonomeric units which provide to the polymer a suitable hydrophilic/hydrophobic balance and/or a suitable degree of coalescence or by the use of a matrix material providing the required hydrophilicity or coalescence. In general, increased hydrophobicity and coalescence will render the diffusion control layer relatively less permeable to alkali and to the processing composition prior to the hydrolysis reaction.

In a further embodiment of the present invention, an overcoat layer comprising the polymers hereof may be provided to the image-receiving element or positive component of the film unit contiguous the image-receiving layer and opposite the neutralization layer. Overcoat layers of this type in this position within the film unit may function to control diffusion of alkali or materials soluble in or solubilized by an aqueous alkaline processing composition.

The permeation characteristics of the polymers hereof utilized in timing layers can be evaluated by measuring the time necessary for downward adjustment of the environmental pH to a predetermined lower level as evidenced by color transition of an indicator dye, preferably initially contained in the processing composition, from a colored form at the initially high processing composition pH to a colorless form at said predetermined lower pH level. Evaluations of this type may be carried out utilizing a test structure comprising in order a support, a polymeric acid layer, a test timing layer, and an image-receiving layer. A transparent cover sheet is superposed coextensive the test structure contiguous to the image-receiving layer and an alkaline processing composition (comprising an indicator dye which is highly colored at a pH of 12 or higher and colorless below a predetermined lower pH level of about 9 or 10) is spread between the cover sheet and the image-receiving layer. The indicator dye remains colored, and may be viewed as such through the transparent cover sheet, until the alkali penetrates through the test timing layer to gain access to the polymeric acid whereupon neutralization of a substantial portion of the alkali present occurs to lower the pH to a level at which the indicator dye is colorless. The measurement of the time necessary for substantial "clearing" of the indicator is generally referred to as the "clearing time". Test structures comprising timing layers which allow a slow initial leakage of alkali and gradually become more permeable show no precipitous change in color but rather a gradual clearing while structures comprising the timing layers described herein will show a precipitous change in color after an initial delay evidencing the rapid change in alkali permeability undergone by the timing layer upon hydrolysis.

Figure 3:
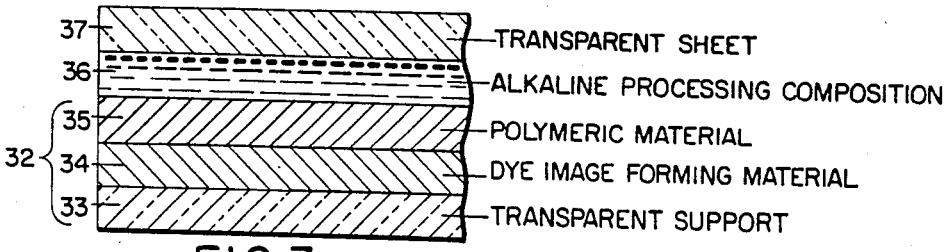
FIG. 3 illustrates a model arrangement for measuring the "hold-time" of interlayers of this invention.

The capacity of diffusion control layers comprising polymers hereof to delay permeation therethrough of dye image-providing materials until conversion by hydrolysis to a relatively dye-permeable condition can be evaluated by utilization of the test structure shown in FIG. 3. In accordance with such structure, transfer of the image dye-providing material through the test diffusion control layer is monitored in relation to time. The "hold-release" properties of the hydrolyzable polymer test material can be evaluated in simulation of the functioning of the material, e.g., as an interlayer in a photosensitive element. Such test structure and a suitable method of evaluation are set forth in detail in Example 6.

The polymers of the present invention can be prepared by polymerization in known manner of a polymerizable monomeric ester of the formula (IV)

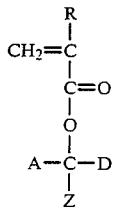

(IV)

wherein R, A, D and Z have the meanings aforedescribed. The monomeric esters of formula (IV) can, for example, be suitably prepared by reaction of an acrylic acid halide (e.g., chloride) of the formula (V):

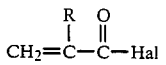

(V)

(wherein R as the aforedescribed meaning and Hal represents halide) with an alcohol having the formula (VI)

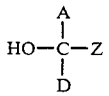

(VI)

(wherein each of A, D and Z has the aforedescribed meaning). Alternatively, the monomeric ester can be prepared by reaction of the acrylic acid with a halogen-substituted ester in accordance with the following representative reaction scheme which illustrates the preparation of carbomethoxymethyl acrylate:

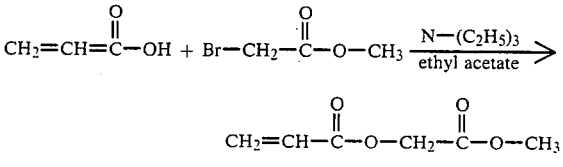

Suitable methods for preparing polymerizable monomeric compounds employed in the production of the hydrolyzable polymers hereof can also be found in *Bull. Chem. Soc. Japan*, 45, 3604 (1972); in *Macromol. Chem.*, 181, 2495 (1980); and in U.S. Pat. No. 2,376,033 (issued May 15, 1945 to A. M. Clifford).

The monomers prepared by any of the above methods may be polymerized according to different polymerization techniques such as bulk, solution, suspension, or emulsion polymerization. In addition, the polymerization may be conducted in the presence of ther suitable polymers, i.e., a polymeric matrix material, to prepare a matrix system which may be used as a diffusion control layer. The polymerization can be initiated chemically, e.g., by suitable free radical or redox initiators or by other means such as heat or incident radiation. As examples of chemical initiators, mention may be made of azobisisobutyronitrile, potassium persulfate, sodium bisulfite, benzoyl peroxide, diacetyl peroxide, hydrogen peroxide, and diazoaminobenzene. It will be appreciated that the chosen means of initiation should be substantially incapable of degrading or otherwise adversely reacting with either the reactants or products of the reaction. The amount of catalyst used and the reaction temperature may be varied to suit particular needs. Generally, the polymerization should proceed satisfactorily by carrying out the reaction at a temperature between 25° C. and 100° C. and using less than 5% by weight of initiator, based on the starting weight of the polymerizable monomer or monomers.

The present invention is further illustrated in the following Examples which are illustrative only and not intended to be of limiting effect. Unless otherwise stated, all parts of percentages are by weight.

EXAMPLE 1

Preparation of hydroxyacetone acrylate:

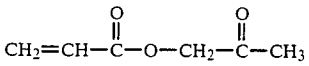

Into a five-liter, three-necked, round-bottom flask (fitted with a power stirrer, a stoppered one-liter addition funnel, a Claisen head bearing a thermometer and condenser with drying tube, and cooling bath) were added acrylic acid (275 mls., 4 moles), methylene chloride (1.6 l.), t-butylpyrocatechol (0.40 gm.) and chloroacetone (320 mls., 3.6 moles). The addition funnel was charged with triethylamine (558 mls., 4 moles).

The flask was cooled in an ice bath until the stirred solution was at 10° C. Triethylamine was added over 20 mins., maintaining the temperature at 18°-20° C.

The ice bath was replaced by a water bath to control the mildly exothermic reaction between 22°-27° C. for 28 hrs.

The mixture was vacuum filtered, and the filter cake was washed with methylene chloride (2×100 mls.) and pressed dry with a rubber dam.

The filtrate was washed with cold saturated NaCl (2×2 l.), dried ($Na_2SO_4$), filtered and evaporated at reduced pressure (35° C.) after more t-butylpyrocatechol (1.5 g) had been added.

The crude, dark amber oil (524-532 gms.) was distilled at reduced pressure through a standard Claisen head, giving, after an initial forerun (30-35 gms.), the hydroxyacetone acrylate as a colorless liquid (307-320 gms., 60-64% yield, b.p. 52°-5° C./1.5-0.9 mm.).

EXAMPLE 2

Preparation of a 40/58/2 (parts by weight) copolymer of hydroxyacetone acrylate/methyl methacrylate/-methacrylic acid.

A mixture of 128 grams of deionized water and 0.20 gram of emulsifier (dioctyl sodium sulfosuccinate, available as Aerosol OT-75 from American Cyanamid Company) was heated to 80° C. under a nitrogen atmosphere. To this mixture was added a first portion (five parts by weight of the total) of a monomeric mixture consisting of 25 grams hydroxyacetone acrylate prepared as described in EXAMPLE 1, 36.2 grams methyl methacrylate, 1.25 grams methacrylic acid and 0.12 gram of Aerosol OT-100 emulsifier. After five minutes, 0.25 gram of ammonium peroxydisulfate was introduced into the resulting mixture. Subsequently, after a one-minute delay, there was commenced the gradual addition of the remaining portion of the aforedescribed mixture (the remaining 95 parts). The addition of this remaining portion was completed in three hours and, thereafter, the reaction contents were maintained at 80° C. for one hour. A latex (yield of 180 grams) having a solids content of 30% by weight was obtained.

EXAMPLE 3

The hydrolyzable polymer prepared in the manner described in Example 2 was evaluated using a test structure, 32 in FIG. 3, comprising a transparent support 33; a layer 34 comprising about 215 mg./m$^2$ of a cyan dye developer of the formula

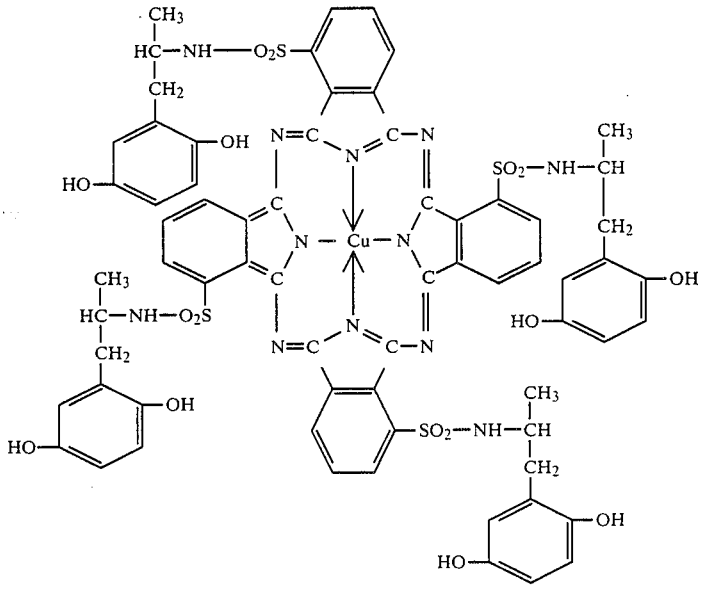

about 430 mg./m.$^2$ gelatin, and about 16 mg./m.$^2$ of succindialdehyde; and a layer 35 containing about 2150 mg./m.$^2$ of the polymeric material. Layers 34 and 35 were coated sequentially on support 33 using a conventional loop coater.

A transparent sheet 37 comprising a polyester clear film base was superposed with test structure 32 and an opaque alkaline processing composition 36 comprising:

| | |
|---|---|
| Potassium hydroxide (45% aqueous solution) | 23.93 g. |
| Benzotriazole | 1.33 g. |
| 6-Methyl uracil | 0.72 g. |
| Bis-(β-aminoethyl)-sulfide | 0.05 g. |
| Colloidal silica, aqueous dispersion (30% $SiO_2$) | 4.48 g. |
| Titanium dioxide | 92.1 g. |
| N—phenethyl α-picolinium bromide (50% aqueous solution) | 6.18 g. |
| N—2-hydroxyethyl-N,N'N'—triscarboxymethyl ethylene diamine | 1.81 g. |
| 4-Amino pyrazolo(3,4d)pyrimidine | 0.60 g. |
| Carboxymethyl hydroxyethyl cellulose | 4.84 g. |
| Water | 100 g. |

was introduced between polymeric test material mayer 35 and transparent sheet 37 at a gap of 0.071 mm. Immediately after introduction of the processing composition the optical reflection density to red light of the sample was monitored through transparent support 33 as function of time by use of a MacBeth Quanta-Log densitometer equipped with a strip-chart recorder. The density measured as a function of time was that of the cyan dye developer in the original dye-containing layer 34 and the cyan dye developer in polymer test layer 35. Dye developer which had diffused through test layer 35 into the processing composition was masked by the titanium dioxide contained therein and, thus, did not contribute to the red absorption. In this manner, the diffusion of dye developer through the test layer and into the processing composition could be monitored.

Figure 4:
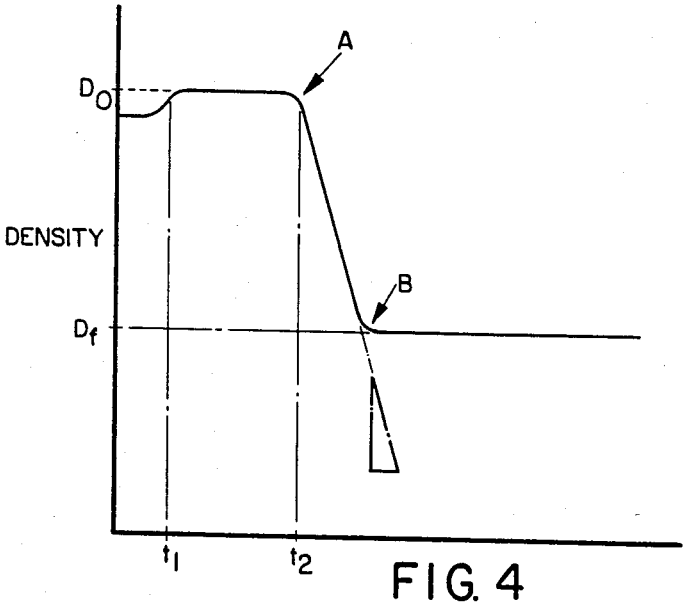
FIG. 4 is a graphical depiction of dye density as a function of time in a system including an interlayer of the present invention.

In FIG. 4 is shown a curve of red absorption density as a function of time where $t_1$ is the time for the cyan dye developer to become wetted by the processing composition, $t_2$ is the total time the cyan dye developer is held back by the polymer interlayer, $D_o$ is the absorption density after dissolution of the dye developer, and $D_f$ is the final absorption density of the residual dye developer remaining in layers 34 and 35 after completion of dye diffusion. The slope of the line segment between A and B is calculated and serves as an indication of the rapidity with which the test layer undergoes a change in dye permeability.

The polymeric material prepared as described in EXAMPLE 2 herein was blended with a matrix copolymer and was coated and evaluated as a diffusion control test layer 35 in the above-described test structure. Values for $t_1$ and $t_2$ (in seconds) and slope were determined. The polymeric material of EXAMPLE 2 is referred to in Table 1 as Component X. The blend was comprised of 30 parts Component X and 70 parts of Component Y (a copolymer of diacetone acrylamide/butylacrylate/acrylic acid/2-acrylamido-2-methylpropane sulfonic acid, 50.5/44/5/0.5 parts by weight, respectively). Results are reported in Table 1 as follows:

TABLE 1

| Poylmeric Product | $t_1$ | $t_2$ | Slope |
|---|---|---|---|
| 30/70 Mixture of Components X and Y | 0 | 20 | 6.7 |

EXAMPLE 4

Preparation of carbomethoxymethyl acrylate:

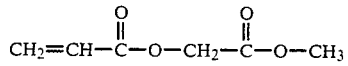

Into a five-liter, three-necked, round-bottom flash (equipped with a mechanical stirrer, a thermometer and a one-liter dropping funnel topped with a drying tube) were placed 527.9 mls. of acrylic acid, 662.7 mls. of methyl bromoacetate and 1750 mls. of ethyl acetate. The resulting solution was cooled to about 15° C. and 1073.2 mls. of triethylamine were added over a period of about one hour. An exotherm was noted and reaction temperature was maintained between 15° and 25° C. with an ice/salt cooling bath. Upon completion of the triethylamine addition, the cooling bath was removed and the reaction mixture was stirred at room temperature (25° to 30° C.) overnight. The resulting thick slurry was poured into 1750 mls. of distilled water and the organic layer was separated. The aqueous layer was extracted with ethyl acetate (two times, 500 mls. each) and the combined organic portions were washed successively with 500 mls. of 0.5N hydrochloric acid, 500 mls. of saturated aqueous sodium bicarbonate and, then, with 500 mls. of saturated aqueous sodium chloride. The organic solution (about 3.5 to 3.75 liters) was then dried (magnesium sulfate) and evaporated in vacuo (water aspirator) at ≦30° C. to provide a very pale-yellow product. The product was purified by addition of one gram of 2,6-di-tert-butyl-p-cresol as a free radical inhibitor and vacuum distilling through a distillation column. The purified product exhibited a boiling point of 50° C. (1.2 mm.) to 56° C. (1.9 mm.).

EXAMPLE 5

Preparation of matrix/hydrolyzable unit polymer system comprising 80 parts of 50.5/44/4/0.5 copolymer of diacetone acrylamide/butyl acrylate/acrylic acid/2-acrylamido-2-methylpropane sulfonic acid; and 20 parts 75/25 copolymer of carbomethoxymethyl acrylate/diacetone acrylamide.

Into a 12-liter flask (equipped with a mechanical stirrer, nitrogen inlet tube, thermometer, condenser and a monomer inlet) were placed 10 kilograms of a copolymeric latex of diacetone acrylamide/butyl acrylate/acrylic acid/2-acrylamido-2-methylpropane sulfonic acid (50.5/44/5/0.5 parts by weight), the solids content of the latex being 29.5% by weight. The latex was agitated and the pH adjusted to 3 by addition of 478 grams of 1% (by weight) sodium hydroxide solution over a 30-minute period. The nitrogen inlet tube was placed below the surface of the liquid contents of the flask and the flow of nitrogen was set at two cc./min. The latex was slowly heated over a two-hour period to 80° C. with continued stirring and nitrogen flow. A solution of polymerization initiator (prepared by dissolving 2.66 grams of ammonium persulfate in 167 mls. of deionized water that had been nitrogen purged for at least ten minutes) was placed into a dropping funnel and was added to the reaction flask at maximum rate. After one minute, the subsurface nitrogen purge was changed to a blanket and the flow was increased to five cc./min. At 1.5 minutes after the addition of the initiator solution, the addition of a solution of monomers was commenced, at a feed rate of 8.15 cc./minute. The addition was effected uniformly over a period of 1.5 hours. The monomer feed solution (which had been prepared by stirring together 183.3 grams of diacetone acrylamide, 550 grams of carbomethoxymethyl acrylate prepared as described in EXAMPLE 4, and 0.62 gram of Aerosol OT-100 emulsifier and filtering the mixture) contained the respective polymerizable monomers thereof at a ratio of 25/75 by weight. Upon completion of the introduction of the monomer feed, the reaction vessel contents were heated for 90 minutes at a temperature of 80° C. The polymerization product was cooled to room temperature and filtered through cheese cloth. The solids content of the polymeric product was about 31.3% by weight.

EXAMPLE 6

Preparation of 39.25/30.00/0.25/15.25/15.25 copolymer of diacetone acrylamide/butyl acrylate/acrylic acid/ethyl acrylate/carbomethoxymethyl acrylate.

Into a five-liter, three-necked, round-bottom flash (equipped with a mechanical stirrer, nitrogen inlet tube, thermometer, condenser and monomer inlet tube) were charged 1721.6 grams of water. The water was stirred and sparged for at least 45 minutes with a stream of nitrogen (1200 cc./min.) while heating to 80° C. Emulsifier (4.8 grams of Aerosol OT-75) was charged to the vessel. A solution of monomer feed was prepared by: mixing in a beaker 509.4 grams diacetone acrylamide, 389.4 grams butyl acrylate, 3.0 grams acrylic acid, 198 grams ethyl acrylate, 198 grams carbomethoxymethyl acrylate and 3.2 grams Aerosol OT-75; placing the mixture in a 35° C. water bath; stirring the contents to facilitate dissolution, while maintaining the temperature below 25° C.; and filtering the resulting solution. A solution of initiator was prepared by mixing 40 mls. of water and 7.3 grams ammonium persulfate and the initiator solution was set aside.

A first portion of the monomer feed solution (65 grams; 5% of the solution) was charged to the reaction vessel without opening the vessel to the atmosphere. One minute after the charge of this portion, the nitrogen inlet tube was adjusted above the liquid surface to provide a nitrogen blanket and flow was reduced to 80 cc/minute. The initiator solution was then charged to the reaction vessel without opening the vessel to the atmosphere. After two minutes, the remaining portion (95%) of the monomer feed solution was introduced uniformly over a four-hour period. Upon completion of this addition, the batch was heated for one hour at 80°

C., was cooled to ambient temperature and filtered through cheese-cloth to provide a polymeric latex.

EXAMPLE 7

A photographic diffusion transfer film unit was prepared in the following manner. A seven-mil (0.18 mm.) subbed polyethylene terephthalate transparent support (containing a minor amount of carbon black for protection against light piping and halation effects) was coated successively with the following layers:

1. a polymeric acid layer, coated at a coverage of about 10,000 mgs./m.$^2$ comprising approximately 9 parts of a half butyl ester of polyethylene/maleic anhydride copolymer and one part of polyvinyl butyral;

2. as a timing layer, coated at a coverage of about 6000 mgs./m.$^2$, a layer of the polymer described in EXAMPLE 6 and prepared in the manner there described;

3. a blue-sensitive silver iodobromide emulsion layer coated at a coverage of about 1300 mgs./m.$^2$ of silver (1.11 microns) and about 650 mgs./m.$^2$ of gelatin;

4. a yellow dye developer layer made up of about 1150 mgs./m.$^2$ of the following yellow dye developer

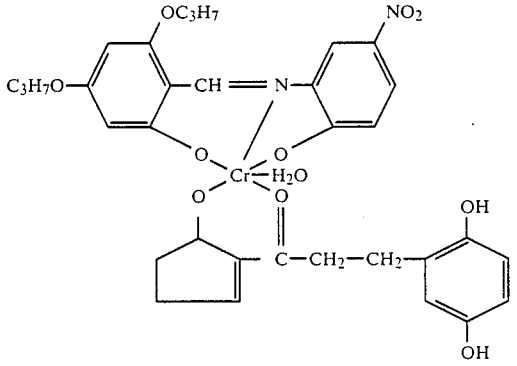

about 566 mgs./m$^2$ of gelatin; about 45 mgs./m.$^2$ of 4-(1-phenyl 1,2,3,4-tetrazolyl-5-thiomethyl)-imidazole; and about 115 mgs./m.$^2$ of 4'-methyl phenyl hydroquinone;

5. as an interlayer, 85 parts of a 50.5/44/4/0.5 copolymer of diacetone acrylamide/butyl acrylate/acrylic acid/2-acrylamido-2-methylpropane sulfonic acid and 15 parts of a 75/25 copolymer of carbomethoxymethyl acrylate/diacetone acrylamide, the polymer mixture coated at a coverage of about 3000 mgs./m.$^2$, about 143 mgs./m.$^2$ of triethanolamine and about 24 mgs./m.$^2$ of succindialdehyde;

6. a green sensitive silver iodobromide emulsion layer coated at a coverage of about 896 mgs./m.$^2$ of silver (1.11 microns) and about 394 mgs./m.$^2$ of gelatin;

7. a magenta dye developer layer made up of about 500 mgs./m.$^2$ of the following magenta dye developer

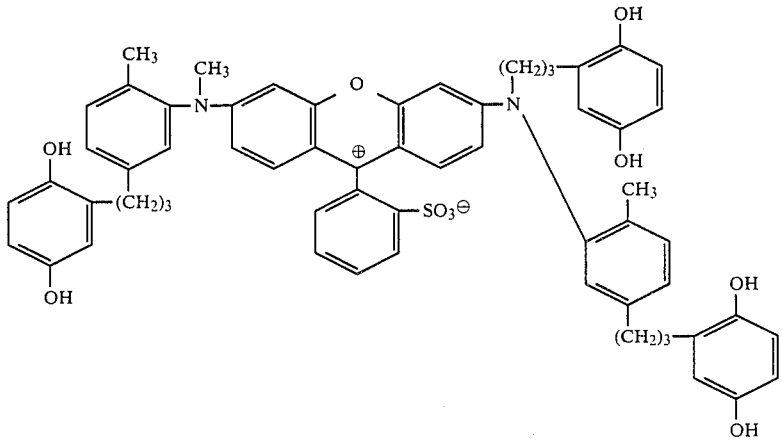

about 321 mgs./m.$^2$ of gelatin; about 30.5 mgs./m.$^2$ of 4-(1-phenyl 1,2,3,4-tetrazolyl-5-thiomethyl)-imidazole; and about 115 mgs./m.$^2$ of 4'-methyl phenyl hydroquinone;

8. as an interlayer, the 85/15 polymer mixture described in layer 5 hereof, the mixture coated at a coverage of about 2500 mgs./m.$^2$, about 119 mgs./m.$^2$ triethanolamine and about 20 mgs./m.$^2$ of succindialdehyde;

9. a red-sensitive silver iodobromide emulsion layer coated at a coverage of about 866 mgs./m.$^2$ of silver (1.11 microns) and about 520 mgs./m.$^2$ of gelatin;

10. a cyan dye developer layer made up of about 425 mgs./m.$^2$ of the following cyan dye developer

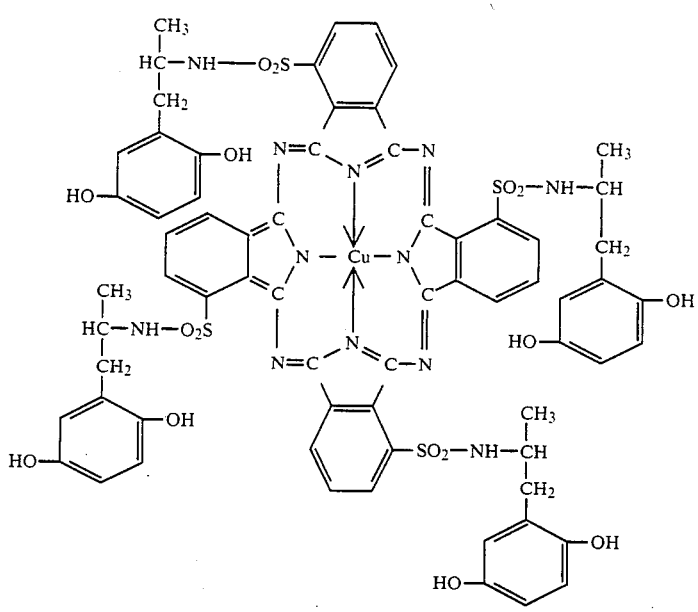

about 323 mgs./m.$^2$ of gelatin, about 37.0 mgs./m.$^2$ of 4-(1-phenyl 1,2,3,4-tetrazolyl-5-thiomethyl)-imidazole; about 121 mgs./m.$^2$ of 4'-methyl phenyl hydroquinone;

11. as an interlayer, the 85/15 polymer mixture described in layer 5 hereof, the mixture coated at a coverage of about 2500 mgs./m.$^2$ and 119 mgs./m.$^2$ triethanolamine;

12. an opacification layer made up of about 1500 mgs./m.$^2$ of carbon black and about 309 mgs./m.$^2$ of polyethylene oxide; about 94 mgs./m.$^2$ of Teflon (duPont Teflon 30); and about 750 mgs./m.$^2$ of Rhoplex HA-12 polyacrylamide latex (Rohm & Haas);

13. a reflective layer made up of about 11000 mgs./m.$^2$ of titanium dioxide, about 1467 mgs./m.$^2$ of polyethylene oxide, about 917 mgs./m.$^2$ of Rhoplex HA-12 polyacrylamide latex (Rohm & Haas) and about 1467 mgs./m.$^2$ of Teflon (duPont Teflon 30);

14. an image-receiving layer coated at a coverage of about 2000 mgs./m.$^2$ of a graft copolymer comprised of 4-vinyl pyridine (4VP) and vinyl benzyl trimethulammonium chloride (TMQ) grafted onto hydroxyethyl cellulose (HEC) at a ratio HEC/4VP/TMQ of 2.2/2.2/1; and 15. a topcoat layer made up of about 2000 mgs./m.$^2$ of sodium cellulose sulfate and about 29 mgs./m.$^2$ of polyacrylamide.

The photographic film unit was photoexposed (four meter-candle-seconds) to a test target, or step wedge, from the direction of the transparent support. The film unit was then processed in a darkroom in a bath of alkaline photographic processing composition by introducing the photoexposed film unit into a light-tight chamber containing a photographic processing composition (at room temperature, 22° C.) having the following composition:

| Ingredients | Parts by Weight |
|---|---|
| Potassium hydroxide | 5 |
| Zinc acetate dihydrate | 0.74 |
| Tetramethyl reductic acid | 0.20 |
| N—(n-pentyl)-α-picolinium bromide | 2.2 |

-continued

| Ingredients | Parts by Weight |
|---|---|
| Water | Balance to 100 |

After an imbibition period of 2.5 minutes, the film unit was removed from the bath through a pair of rollers (to remove excess fluid) and into the darkness of the darkroom where the film unit remained for an additional 1.5 minutes. The film unit was then brought into ambient light. A photographic image was viewed as a reflection image against light-reflecting layer 13 described hereinbefore.

Red, green and blue Dmax and Dmin values were measured and are reported in the following Table IV:

TABLE IV

| Dmin | | | Dmax | | |
|---|---|---|---|---|---|
| R | G | B | R | G | B |
| 0.23 | 0.21 | 0.21 | 1.91 | 2.34 | 1.88 |

What is claimed is:

1. A photographic diffusion transfer film unit comprising:

a support layer;

a photosensitive silver halide emulsion layer having associated therewith a diffusion transfer process image-providing material;

an alkaline processing composition permeable image-receiving layer; and, in addition to said layers;

at least one diffusion control layer including a hydrolyzable polymer, the layer being adapted to conversion from a condition of impermeability to alkali or materials soluble in or solubilized by an alkaline processing composition to a condition of substantial permeability thereto, by a predetermined hydrolysis of the polymer under the alkaline conditions of an alkaline photographic processing composition, and being free of permeation-promoting materials which adversely affect the capacity of the layer to maintain said condition of impermeability until the occurrence of said predetermined hydrolysis, the hydrolyzable polymer comprising repeating units having the formula

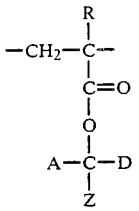

wherein R is hydrogen, halogen or lower alkyl; A and D are each independently hydrogen, alkyl, alkoxy, aryl, alkaryl or aralkyl; and Z represents an electron-withdrawing group which, upon contact of the polymer with alkali, activates the hydrolytic degradation of the polymer with accompanying formation of an acrylate anion, or represents an electron-withdrawing group which, upon contact of the polymer with alkali, is itself hydrolyzed with accompanying formation of a residual carboxylate anion.

2. The diffusion transfer film unit of claim 1 wherein said electron-withdrawing group Z is a group which, upon contact of the polymer with alkaline processing composition, activates the hydrolytic degradation of pendant ester groups of the polymer with accompanying formation of carboxylic anion groups.

3. The diffusion transfer film unit of claim 2 wherein said Z group is a group having the formula

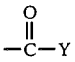

where Y is $-R^2$ or $-OR^2$ and $R^2$ is alkyl, aryl, alkaryl or aralkyl.

4. The diffusion transfer film unit of claim 3 wherein said Z group is

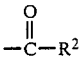

where $R^2$ is alkyl.

5. The diffusion transfer film unit of claim 3 wherein said Z group is

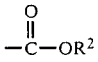

where $R^2$ is alkyl.

6. The diffusion transfer film unit of claim 5 wherein each of A and D is hydrogen.

7. The diffusion transfer film unit of claim 1 wherein said diffusion control layer including said hydrolyzable polymer is a layer permeable to alkali but substantially impermeable to processing composition soluble and diffusible dye image-forming material until hydrolysis of said hydrolyzable polymer.

8. The diffusion transfer film unit of claim 1 wherein said diffusion control layer including said hydrolyzable polymer is a layer substantially impermeable to processing composition until hydrolysis of said hydrolyzable polymer.

9. The diffusion transfer film unit of claim 1 wherein said diffusion control layer includes a matrix polymer in which is polymerized said hydrolyzable polymer.

10. The diffusion transfer film unit of claim 9 wherein said matrix polymer is a copolymer comprising recurring comonomeric units selected from the group consisting of acrylic acid; methacrylic acid; methylmethacrylate; 2-acrylamido-2-methylpropane sulfonic acid; acrylamide; methacrylamide; N,N-dimethylacrylamide; ethylacrylate; butylacrylate; diacetone acrylamide; acrylamido acetamide; and methacrylamido acetamide.

11. The diffusion transfer film unit of claim 1 wherein said image-providing material is a dye developer.

12. The diffusion transfer film unit of claim 1 comprising at least two selectively sensitized silver halide emulsion layers, each associated with an image dye-providing material which provides an image dye possessing spectral absorption characteristics substantially complementary to the predominant sensitivity range of its associated emulsion, wherein said diffusion control layer is an interlayer positioned between said silver halide emulsion layers, and their associated image dye-providing materials.

13. The diffusion transfer film unit of claim 12 wherein said diffusion control layer is permeable to alkali but impermeable to said image dye-providing materials until hydrolysis of said hydrolyzable polymer.

14. A photosensitive element for use in diffusion transfer photographic processes comprising:

a support layer;

a negative component comprising at least one photosensitive silver halide emulsion layer having associated therewith a diffusion transfer process image-providing material; and, in addition to said layers, at least one diffusion control layer including a hydrolyzable polymer, the layer being adapted to conversion from a condition of impermeability to alkali or to materials soluble in or solubilized by an alkaline processing composition to a condition of substantial permeability thereto, by a predetermined hydrolysis of the polymer under the alkaline condition of an alkaline photographic processing composition, and being free of permeation-promoting materials which adversely affect the capacity of the layer to maintain said condition of impermeability until the occurrence of said predetermined hydrolysis, the hydrolyzable polymer comprising repeating units having the formula

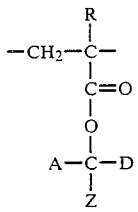

wherein R is hydrogen, halogen or lower alkyl; A and D are each independently hydrogen, alkyl, alkoxy, aryl, alkaryl or aralkyl; and Z represents an electron-withdrawing group which, upon contact of the polymer with alkali, activates the hydrolytic degradation of the polymer with accompanying formation of an acrylate anion, or represents an electron-withdrawing group which, upon contact of the polymer with alkali, is itself hydrolyzed with accompanying formation of a residual carboxylate anion.

15. The photosensitive element of claim 14 wherein said electron-withdrawing group Z is a group which, upon contact of the polymer with alkaline processing composition, activates the hydrolytic degradation of pendant ester groups of the polymer with accompanying formation of carboxylic anion groups.

16. The photosensitive element of claim 15 wherein said Z group is a group having the formula $$-\overset{\overset{\displaystyle O}{\|}}{C}-Y$$

where Y is $-R^2$ or $-OR^2$ and $R^2$ is alkyl, aryl, alkaryl or aralkyl.

17. The photosensitive element of claim 16 wherein said Z group is $$-\overset{\overset{\displaystyle O}{\|}}{C}-OR^2$$

where $R^2$ is alkyl.

18. The photosensitive element of claim 17 wherein each of A and D is hydrogen.

19. The photosensitive element of claim 14 comprising at least two selectively sensitized silver halide emulsion layers, each associated with an image dye-providing material which provides an image dye possessing spectral absorption characteristics substantially complementary to the predominant sensitivity range of its associated emulsion, wherein said diffusion control layer is an interlayer positioned between said silver halide emulsion layers, and their associated image dye-providing materials.

20. The photosensitive element of claim 19 wherein said diffusion control interlayer is permeable to alkali but impermeable to said image dye-providing materials until hydrolysis of said hydrolyzable polymer.

21. The diffusion transfer film unit of claim 1 wherein there is present a neutralization layer and wherein said diffusion control layer including said hydrolyzable polymer is a neutralization timing layer substantially impermeable to processing composition until hydrolysis of said hydrolyzable polymer.

22. An image-receiving element comprising:

a support layer;

a neutralizing layer; and, in addition to said layers;

a neutralizing timing layer including a hydrolyzable polymer, the layer being adapted to conversion from a condition of impermeability to alkali to condition of substantial permeability thereto, by a predetermined hydrolysis of the polymer under the alkaline conditions of an alkaline photographic processing composition, and being free of permeation-promoting materials which adversely affect the capacity of the layer to maintain said condition of impermeability until the occurrence of said predetermined hydrolysis, the hydrolyzable polymer comprising repeating units having the formula

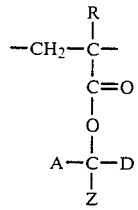

wherein R is hydrogen, halogen or lower alkyl; A and D are each independently hydrogen, alkyl, alkoxy, aryl, alkaryl or aralkyl; and Z represents an electron-withdrawing group which, upon contact of the polymer with alkali, activates the hydrolytic degradation of the polymer with accompanying formation of an acrylate anion, or represents an electron-withdrawing group which, upon contact of the polymer with alkali, is itself hydrolyzed with accompanying formation of a residual carboxylate anion; and an image-receiving layer.

23. The image-receiving element of claim 22 wherein said electron-withdrawing group Z is a group which, upon contact of the polymer with alkaline processing composition, activates the hydrolytic degradation of pendant ester groups of the polymer with accompanying formation of carboxylic anion groups.

24. The image-receiving element of claim 23 wherein said Z group is $$-\overset{\overset{\displaystyle O}{\|}}{C}-OR^2$$

where $R^2$ is alkyl.

25. The image-receiving element of claim 24 wherein each of A and D is hydrogen.

* * * * *